US010578395B2

(12) United States Patent
Mock et al.

(10) Patent No.: US 10,578,395 B2
(45) Date of Patent: Mar. 3, 2020

(54) GRIP ACTIVATION SYSTEM FOR FIREARM ACCESSORY

(71) Applicant: Crosman Corporation, Bloomfield, NY (US)

(72) Inventors: Jeffrey W. Mock, Rochester, NY (US); John A. Kowalczyk, Jr., Fairport, NY (US); Eric St. Phillips, Fairport, NY (US); Jeffrey D. Tuller, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 15/694,153

(22) Filed: Sep. 1, 2017

(65) Prior Publication Data

US 2018/0058805 A1 Mar. 1, 2018

Related U.S. Application Data

(60) Provisional application No. 62/382,475, filed on Sep. 1, 2016.

(51) Int. Cl.
*F41C 23/10* (2006.01)
*F41G 1/35* (2006.01)

(52) U.S. Cl.
CPC ..... *F41C 23/10* (2013.01); *F41G 1/35* (2013.01)

(58) Field of Classification Search
CPC .. F41A 21/10; F41A 3/16; F41A 21/48; F41C 7/00
USPC ..... 42/90, 71.02
See application file for complete search history.

(56) References Cited

U.S. PATENT DOCUMENTS 1,338,239 A * 4/1920 Matys ..... F41C 23/22 362/114
4,079,534 A * 3/1978 Snyder ..... F41G 1/35 362/110
4,313,272 A * 2/1982 Matthews ..... F41G 11/001 42/115
4,313,273 A * 2/1982 Matthews ..... F41G 11/001 42/117
5,056,254 A 10/1991 Bechtel
5,179,235 A 1/1993 Toole
5,208,826 A * 5/1993 Kelly ..... F41G 1/35 248/176.1
5,282,594 A 2/1994 Huang
5,294,007 A 3/1994 Edmondson
5,375,362 A 12/1994 McGarry et al.
(Continued)

OTHER PUBLICATIONS

Gun Digest Editors, First Look: Crimson Trace LINQ Wireless Laser Sight, www.gundigest.com/reviews/crimson-trace-linq-wireless-laser-sight; Mar. 14, 2016.

*Primary Examiner* — Samir Abdosh
(74) *Attorney, Agent, or Firm* — Lee & Hayes, P.C.

(57) ABSTRACT

Firearm accessories and methods are provided in which a grip force is received at a grip force receiving surface that is positioned at least one half of a trigger guard away from an actuation sensor in the accessory, at least a portion of a grip force is used to create a change in a physical condition proximate to the actuation sensor that the actuation sensor is adapted to sense; and the sensed change in physical condition is used to determine a control output for an electronic system in the firearm accessory.

12 Claims, 13 Drawing Sheets

(56) References Cited

U.S. PATENT DOCUMENTS 5,485,695 A 1/1996 Glock
5,531,040 A 7/1996 Moore
5,581,898 A * 12/1996 Thummel ..... F41G 1/35 42/114
5,590,486 A 1/1997 Moore
5,621,999 A 4/1997 Moore
5,654,594 A * 8/1997 Bjornsen, III ..... F41A 35/06 200/293.1
5,706,600 A 1/1998 Toole et al.
5,758,448 A 6/1998 Thummel
5,913,669 A * 6/1999 Hansen ..... F41G 1/36 362/110
6,230,431 B1 5/2001 Bear
6,276,088 B1 * 8/2001 Matthews ..... F21L 4/005 362/110
6,393,752 B1 5/2002 Oliver et al.
6,941,693 B2 * 9/2005 Rice ..... F41A 17/06 42/71.01
7,117,624 B2 * 10/2006 Kim ..... F41G 11/003 42/85
7,117,627 B2 10/2006 Woodmansee, III et al.
7,275,344 B2 10/2007 Woodmansee, III et al.
7,332,682 B2 * 2/2008 Kim ..... F41G 1/34 200/18
7,395,627 B2 7/2008 La France et al.
7,726,061 B1 6/2010 Thummel
7,805,876 B1 * 10/2010 Danielson ..... F41C 23/10 362/114
7,973,257 B2 * 7/2011 Faifer ..... H01H 19/635 200/561
8,109,024 B2 2/2012 Abst
8,117,782 B2 2/2012 Gross et al.
8,256,154 B2 * 9/2012 Danielson ..... F41A 19/11 42/117
8,484,882 B2 7/2013 Haley et al.
8,662,694 B1 3/2014 Izumi
8,727,556 B2 5/2014 Swan
8,769,859 B2 7/2014 Li
8,844,189 B2 9/2014 Moore et al.
9,062,933 B1 6/2015 Allen et al.
9,243,865 B1 * 1/2016 Bruhns ..... F41G 1/35
9,267,759 B2 2/2016 Speroni
9,303,951 B2 4/2016 Hancosky
9,328,994 B2 5/2016 Hovsepian
9,335,109 B2 5/2016 Bensayan et al.
9,488,446 B2 11/2016 Zimmer
10,030,935 B1 7/2018 Ding et al.
10,151,564 B2 12/2018 Galli
2002/0100202 A1 8/2002 Lin et al.
2004/0128900 A1 7/2004 Chen et al.
2005/0257415 A1 11/2005 Solinsky et al.
2005/0268518 A1 * 12/2005 Pikielny ..... F41C 33/0209 42/90
2007/0113462 A1 5/2007 Ho
2007/0193103 A1 8/2007 Cheng
2008/0148619 A1 * 6/2008 Rogers ..... F41G 1/35 42/90
2009/0084016 A1 * 4/2009 Wu ..... F41G 1/35 42/90
2009/0307955 A1 12/2009 NuDyke
2010/0064568 A1 3/2010 NuDyke
2010/0154279 A1 6/2010 Polyzos et al.
2010/0162610 A1 7/2010 Moore et al.
2011/0035984 A1 2/2011 Liu
2011/0047851 A1 3/2011 Mock et al.
2011/0061283 A1 3/2011 Cavallo et al.
2011/0107648 A1 5/2011 Tuz
2011/0167707 A1 7/2011 Gross et al.
2011/0232151 A1 9/2011 Zukowski
2012/0047787 A1 3/2012 Curry
2012/0085015 A1 4/2012 Wei
2012/0144718 A1 6/2012 Danielson et al.
2012/0198748 A1 8/2012 Ospino
2013/0008072 A1 1/2013 Chung
2015/0113851 A1 * 4/2015 Bensayan ..... F41A 17/063 42/117

* cited by examiner

FIG. 1
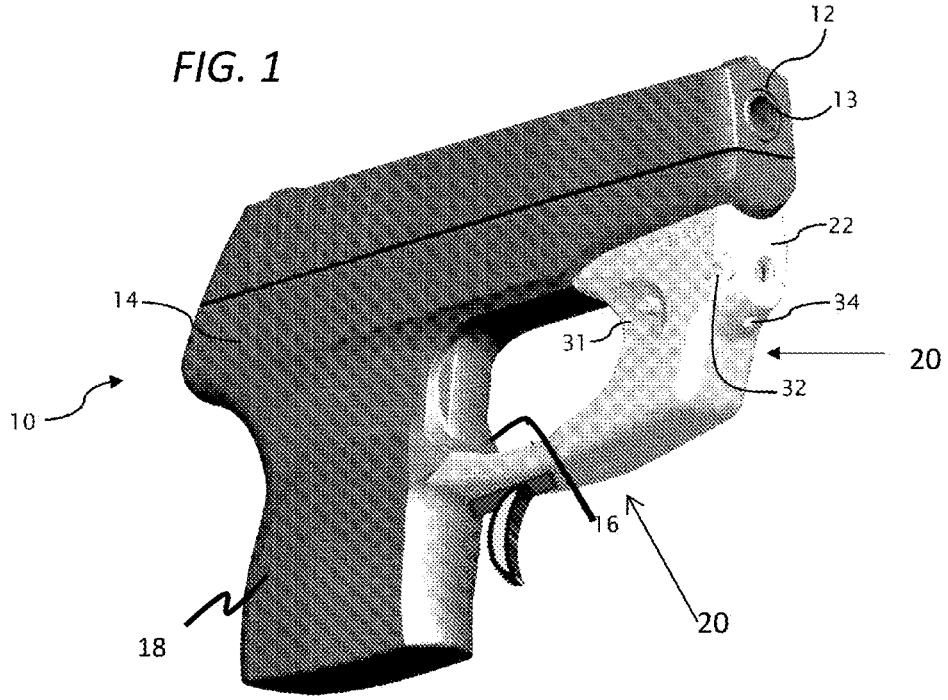
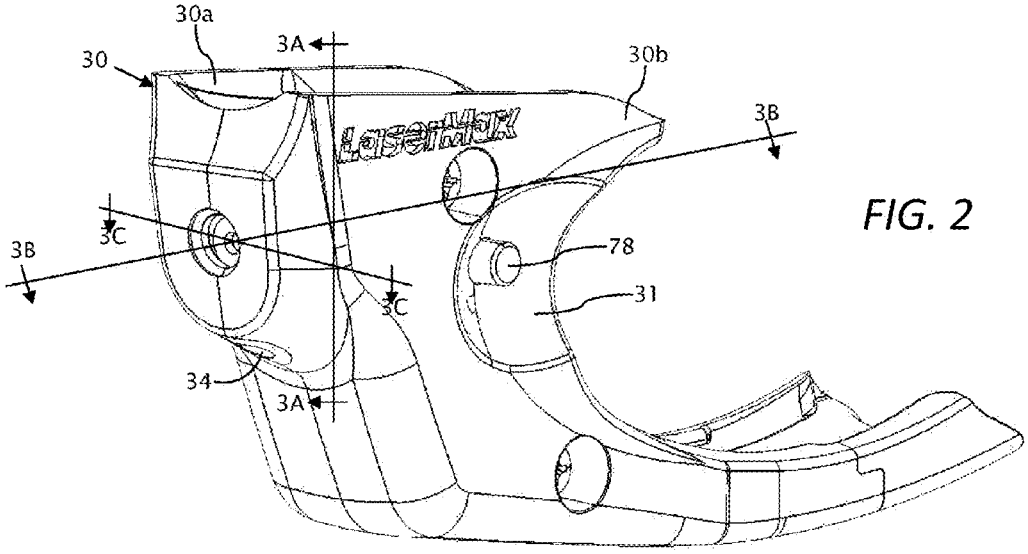
FIG. 2

GRIP ACTIVATION SYSTEM FOR FIREARM ACCESSORY

CROSS REFERENCE TO RELATED APPLICATIONS

This application claims the benefit of U.S. Provisional Application No. 62/382,475 filed Sep. 1, 2016.

STATEMENT REGARDING FEDERALLY SPONSORED RESEARCH OR DEVELOPMENT

Not applicable.

FIELD OF THE INVENTION

The present invention relates to accessories and mechanisms for use with firearms and deterrent devices and methods for activating the same.

DESCRIPTION OF RELATED ART

Electronic firearm accessories such as laser and light devices are well known. There are various ways of joining a such an accessory to a firearm and various ways of activating such an accessory when needed. In one known approach an electro-mechanical switch is located on the grip and electrically connected to a laser that is mounted to the grip. For example, U.S. Pat. No. 8,256,154, entitled "Laser gunsight system for a firearm trigger guard" describes a sighting device for a firearm having a trigger guard, a frame with an underside portion forward of the trigger guard, and a handgrip with a front strap, the sighting device comprising: a body having a first portion including an illumination device; the body defining an engagement feature operable to removably connect to and closely encircle a forward portion of the trigger guard to create a clamping action about the trigger guard; the body having an elongated extension portion extending from the first portion; the extension portion shaped to wrap a bottom surface and left and right sides of the trigger guard from the first portion to the front strap; the extension portion having a free end including a switch; the switch having electrical contacts located below the lower portion of the trigger guard and being electrically connected to electrical contacts at the forward portion of the trigger guard; and the extension portion including an electrical conductor operably connecting the switch to the illumination device. This requires electrical connections and a functioning switch be positioned between a firearm and a grip of a hand holding that firearm. It will be appreciated that this grip force must be maintained whenever the laser is to be active. Further, this switch must be capable of functioning despite being exposed, on one side, to accelerations that occur during firearm discharge and on the other to control forces from a gripping hand. Accordingly such switch based arrangements can be complex and expensive. Further, there is no adjustability in such systems.

In another approach, the LINQ system sold by Crimson Trace Corporation, Wilsonville, Oreg., USA includes switches that are connected to radio frequency transmitters in a firearm grip that must communicate with radio frequency receivers in the firearm accessory. such a solutions are inordinately expensive and unnecessarily complicated.

In yet another approach example, U.S. Pat. No. 9,328,8994, entitled "Flexible switch for laser gun sight" filed by Hovsepian on Jul. 21, 2014, provides a laser sight kit for mounting on a handgun having a triggerguard and a frame extending forward of the trigger guard. The kit has a laser sight configured to be removably secured to the handgun frame at a position forward of the trigger guard, the laser sight having a first electrical contact; a switch operable without displacement of any portion of the switch and without force applied to the switch; at least one second electrical contact; at least one flexible nonconductive carrier, the switch and second contact disposed on carrier with the second contact electrically connected to the switch; and the second carrier, switch and second contact flush surface-mounted when secured to the handgun, with the switch secured to the underside of the trigger guard and the second contact secured to a location forward of the trigger guard such that the laser sight first contact may connect with the second contact. Essentially two electrodes are exposed on the underside of the gun requiring a finger to make contact with the electrodes and provide a conductive path between them. Of course any conductive substance bridging the gap between electrodes will have this effect such that any electrical conductor, including but not limited to water or sweat making contact with both electrodes will activate the laser. Here too there is little or no user adjustability.

What are needed therefore in the art are new approaches to activating firearm accessories that are less complex and less expensive. Additionally, what are needed are new approaches to activating firearm accessories that can be adjusted to the needs of a user.

SUMMARY OF THE INVENTION

Accessories for use with a firearm having a grip, a trigger guard and a barrel extending from the grip past the trigger guard are provided. In one aspect, an accessory has a grip force receiving surface; a housing configured to position an electronic system, a control system, the grip force receiving surface and a linkage relative to the firearm, with the grip force receiving surface positioned proximate to the grip of the firearm such that a person gripping the firearm will apply force against the grip force receiving surface. The grip force receiving surface is associated with the linkage such that a change in the grip force applied against grip force receiving surface causes the linkage to cause a change in a condition that can be sensed by an actuation sensor that is at least a half of a length of the trigger guard away from the grip force receiving surface with the control system determining operation of the electronic system based at least in part on the condition sensed by the actuation sensor.

Methods for actuating an accessory for use with a firearm having a grip, a trigger guard and a barrel extending from the grip past the trigger guard are also provided. In one aspect of such a method, a grip force is received at a grip force receiving surface positioned at least one half of a trigger guard length away from an actuation sensor in the accessory. At least a portion of the grip force is used to create a change in a physical condition proximate to the actuation sensor that the actuation sensor is adapted to sense and the sensed change in physical condition to determine a control output for an electronic system in the firearm accessory.

BRIEF DESCRIPTION OF THE DRAWINGS

FIG. 1 is a perspective view of a firearm accessory having a grip activation system, wherein the laser sight is connected to a firearm.

FIG. 2 is a perspective view of the firearm accessory of FIG. 1.

DETAILED DESCRIPTION OF THE DRAWINGS

Figure 3A:
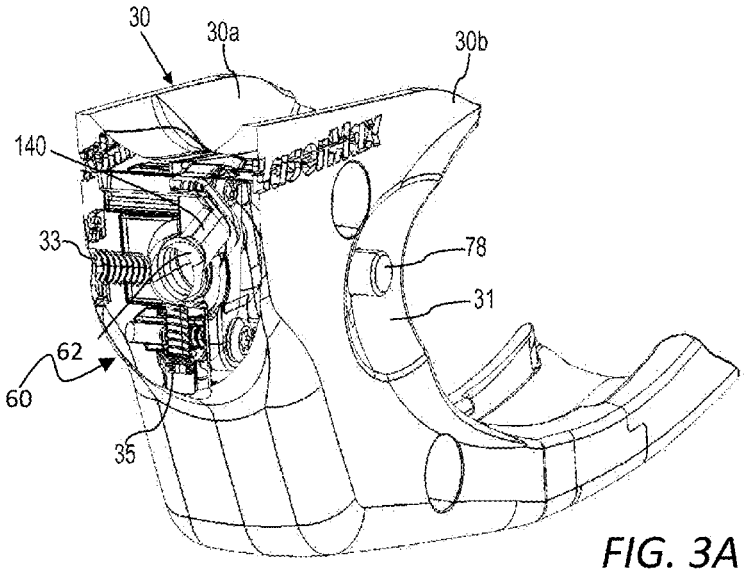
FIG. 3A is a perspective view of the firearm accessory of FIG. 2, taken along line 3A-3A.

FIG. 1 is a perspective view of a firearm accessory 20 having a grip activation system 22, wherein firearm accessory 20 is connected to a firearm 10.

Firearm 10 includes, in part, a barrel 12, a frame 14, a trigger guard 16, and a grip 18. In this embodiment, firearm accessory 20 is shown engaging a trigger guard 16 of the firearm 10, it is understood that firearm accessory 20 can be cooperatively engaged with any portion of firearm 10 and may be incorporated within firearm 10.

For purposes of description, the term "longitudinal" means the dimensions along the direction of the barrel 12. The term "width" means the dimension along a direction transverse to the axis of the barrel 12. The term "axial" means in a direction transverse to the axis of the barrel 12. The term "forward" means nearer to or towards a muzzle 13. The term "rearward" means further from or away from the muzzle 13. The term "below" means lower than, in the intended operating orientation of the firearm 10. The term "above" means higher than, in the intended operating orientation of the firearm 10. The term "preclude movement" means to prevent movement which would otherwise prevent functioning in an intended manner. The term "angular" means rotating about at least one of the longitudinal and axial directions.

Figure 3B:
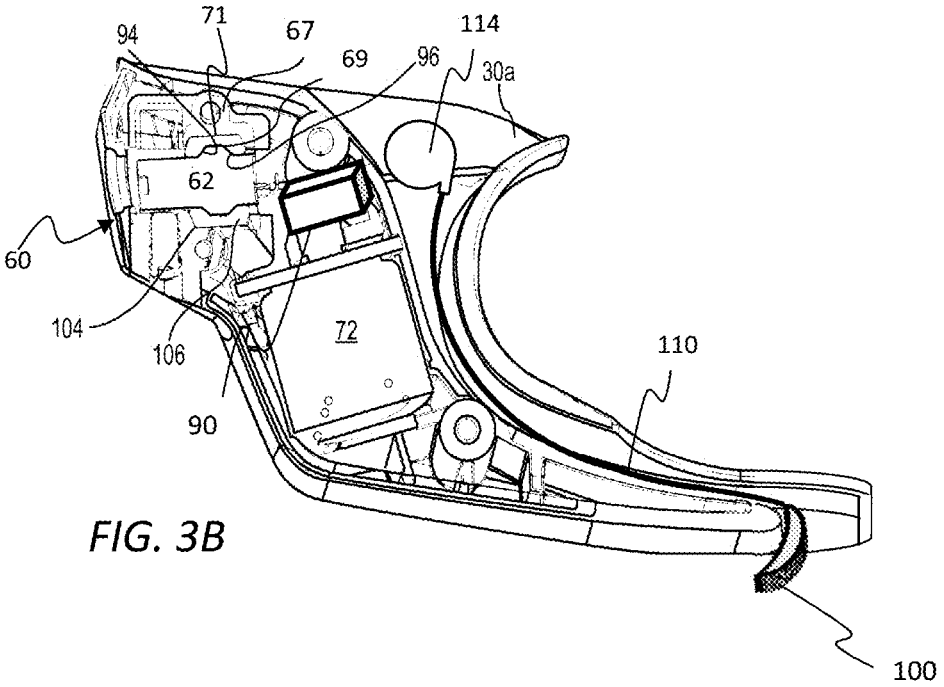
FIG. 3B is a perspective view of the firearm accessory of FIG. 2, taken along line 3B-3B.
Figure 3C:
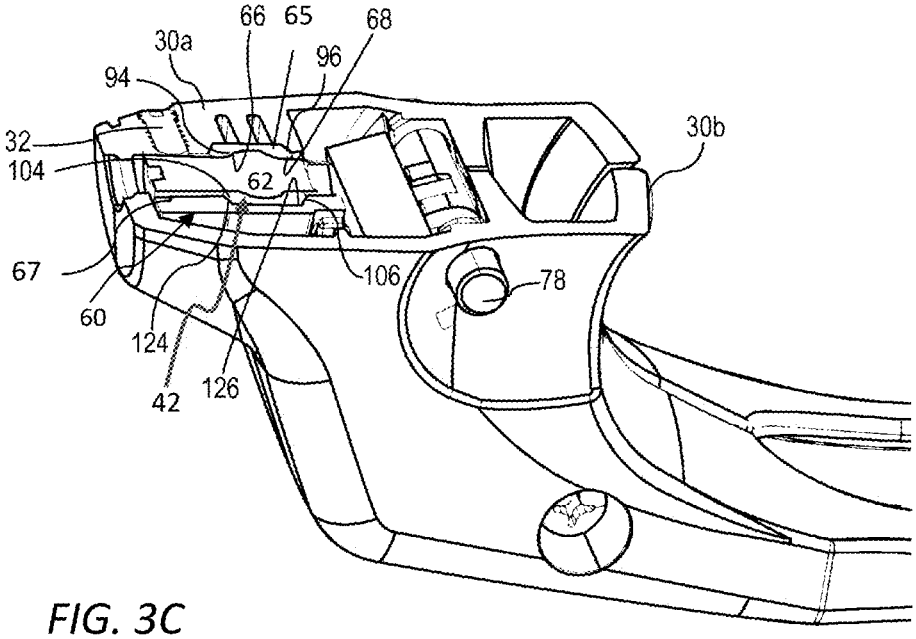
FIG. 3C is a perspective view of the firearm accessory of FIG. 2, taken along line 3C-3C.
Figure 4:
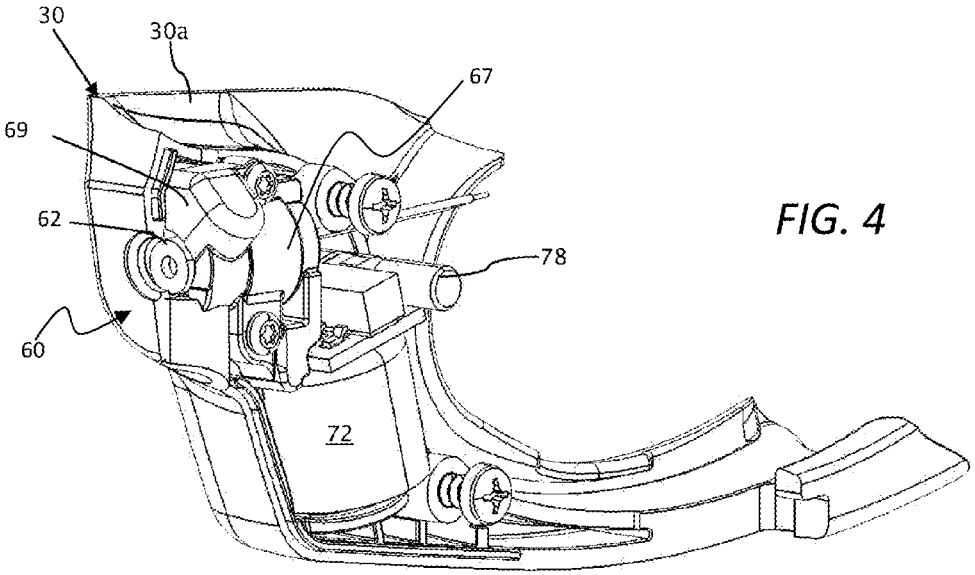
FIG. 4 is a perspective view of the firearm accessory of FIG. 2 with a portion of a housing removed.
Figure 5:
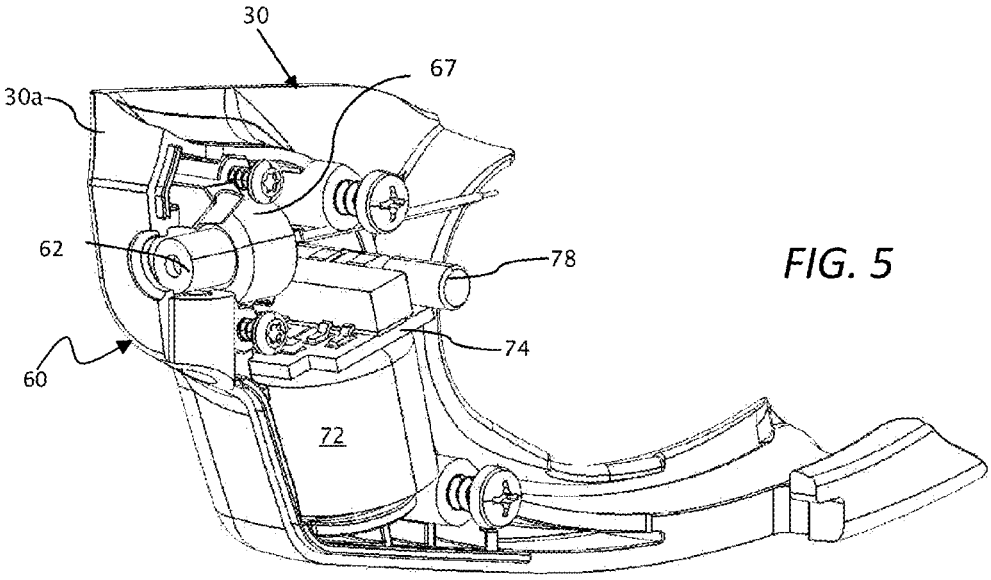
FIG. 5 is the perspective view of FIG. 4 with a laser cover removed.
Figure 6:
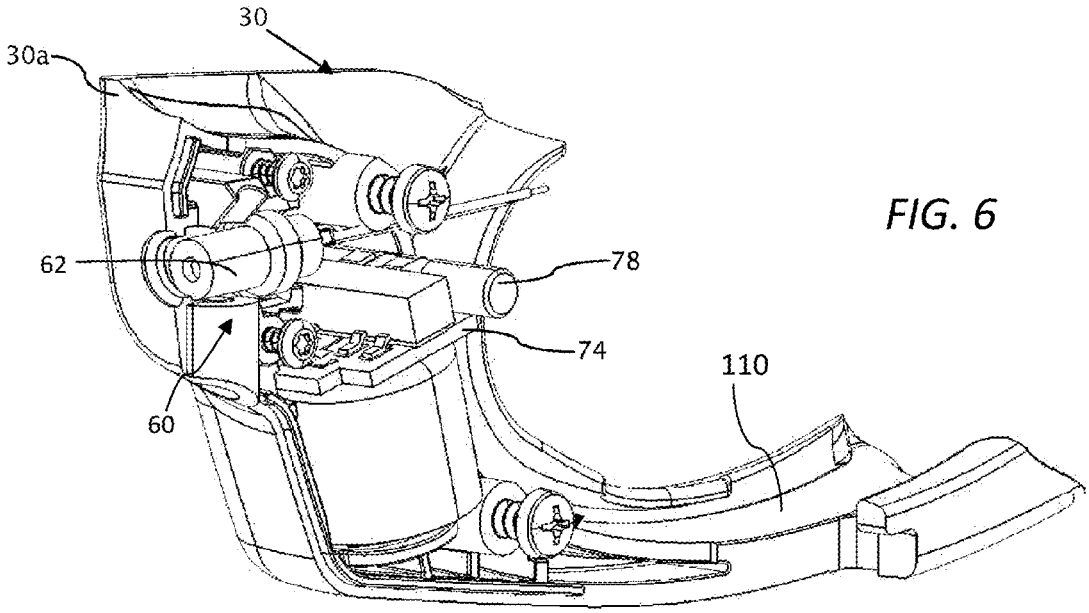
FIG. 6 is a perspective view of the firearm accessory of FIG. 2, having a spring coupling removed.
Figure 7:
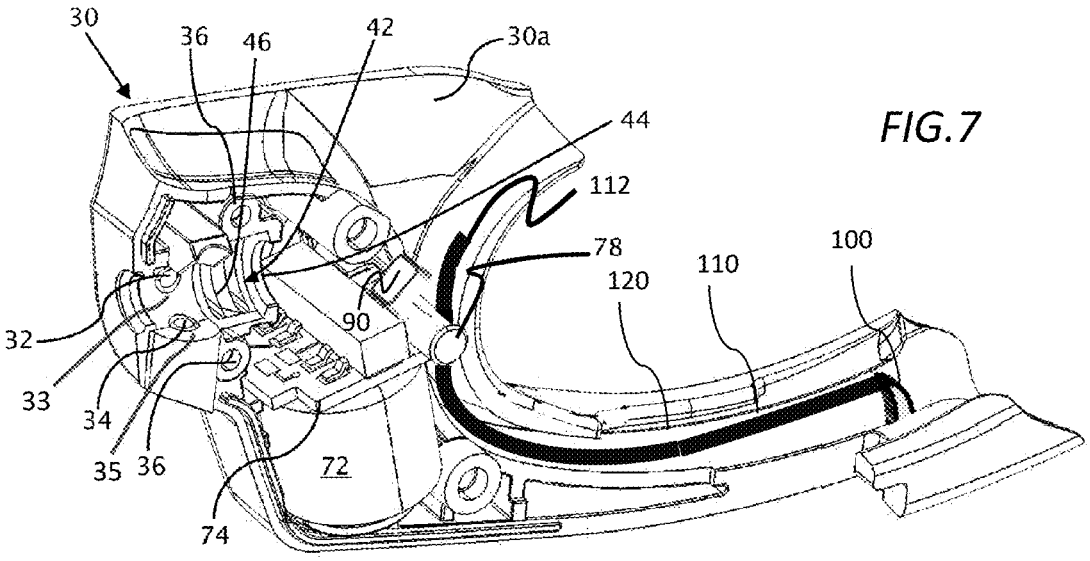
FIG. 7 is a perspective view of the firearm accessory of FIG. 2, having the laser cover, the coupling and the laser module removed and showing a grip receiving surface and a linkage in a passageway in a first unforced position.

FIG. 2 shows a top, front, left side isometric view of firearm accessory 20 with grip activation system 22 separated from firearm 10, while FIG. 3A is a perspective view of the laser sight of FIG. 2, taken along line 3A-3A, FIG. 3B is a perspective view of the laser sight of FIG. 2, taken along line 3B-3B and FIG. 3C is a perspective view of the laser sight of FIG. 2, taken along line 3C-3C. Further details regarding the embodiment of FIGS. 1-3C are shown in FIGS. 4-7. FIG. 4 is a perspective view of the firearm accessory of FIG. 2 with a portion of a housing removed. FIG. 5 shows the view of FIG. 4 with spring coupling 69 removed, while FIG. 6 shows the view of FIG. 5 with resilient coupling 65 removed, and FIG. 7 shows the view of FIG. 6 with laser module 60 removed.

As is shown in FIGS. 1-7, in this embodiment firearm accessory 20 and grip activation system 22 share a common housing 30. In one configuration, housing 30 is formed of mating halves (30*a*, 30*b*). However, it is understood housing 30 can be formed as a single integral component or from a multitude of interconnected components. It has been found satisfactory to injection mold the housing 30 out of an elastomer such as a glass-filled nylon and particularly a nylon 6.6 compound reinforced with 33% glass fiber; suitable for processing by injection molding, wherein the material is lubricated for ease of mold release.

Firearm accessory 20 is shown having a laser system 60 with a laser module 62 for selectively emitting a beam of radiation, such as coherent radiation, along an optical axis, a coupling 65 and a laser cover 67. Laser module 62 has a resilient coupling 65 joined thereto. Resilient coupling 65 is located in a socket 42 that forms between housing 30 and a laser cover 67 and a spring coupling 69 which holds a spring (not shown) that biases laser module 60.

In the embodiment shown in FIGS. 1-7, housing 30 includes at least one and in some configurations, two alignment pins 32, 34. Alignment pins 32, 34 are moveable relative to housing 30 to contact the laser module 62. Here, alignment pins 32, 34 can be perpendicular to each other, wherein movement of one alignment, shown here as alignment pin 34 provides for movement of laser module 62 for elevation control and wherein movement of the remaining alignment pin shown here as alignment pin 32 provides for windage control. Other arrangements are possible. The spring (not shown) held by spring coupling 69 biases laser module 62 against alignment pins 32 and 34.

In one configuration, alignment pins 32, 34 are threadingly engaged with the housing 30 in corresponding through holes 33, 35. Through holes 33, 35 are sized so that the alignment pins cut at least a portion of corresponding threads in the housing 30. Thus, upon initial engagement of the alignment pins 32, 34 with the corresponding through holes 33, 35 the alignment pins cut the threads in the housing 30. It is understood a portion of each through hole 33, 35 may be formed with threads and a remaining of the through holes is formed without threads, such that the threads are formed in the remaining portion by initial engagement of the alignment pins 32, 34.

As seen in FIG. 7, housing 30 includes a socket 42. Socket 42 is sized to cooperatively engage a portion of coupling 65 in an interference fit. In one configuration, socket 42 is formed in one of the halves 30*a* and 30*b* of housing 30. However, it is understood that socket 42 can be formed by any of a variety of constructions which provide an interference fit with coupling 65. Socket 42 includes at least one, and can have two generally planar mating surfaces 44, 46 that incline with respect to corresponding surfaces of the coupling 65. In one configuration, socket 42 of housing 30 has first mating surface 44 inclined toward muzzle 13 and second mating surface 46 inclined away from muzzle 13. Coupling 65 cooperatively engages laser module 62 to form a laser module/coupling subassembly. In embodiments, coupling 65 includes an internal seat 69 for engaging the laser module 62 and an external seat 71 for engaging the housing 30 and laser cover 67. In embodiments, internal seat 69 can include facets 94, 96 for contacting the contact faces 66, 68 of the outer seat 64 of laser module 62 such that an interference fit is formed between the coupling 65 and laser module 62.

The term interference fit means a fit between mating assembled surfaces (parts) that provides an interference and a deviation from nominal dimensions in at least one of the mating surfaces. The interference fit is sufficient to preclude relative longitudinal or axial movement between the coupling 65 and the laser module 62 (or the coupling and the housing 30 or laser cover 67). In one configuration, the interference fit incorporates the contact of two non-parallel generally planar surfaces, such as along a line of contact.

Laser module 62 may be a commercially available assembly or may be manufactured or fabricated for specific purposes or use in particular applications. Depending on the construction of laser module 62 and housing 30, at least one of laser module 62 and housing 30 has a window 70 through which a beam of light from laser module 62 can pass while providing a contained environment within firearm accessory 20. Window 70 may have no substantial impact on a laser beam passing through window 70 may be adapted to optically modify light passing through window 70. In one example window 70 may include a lens providing optical power or otherwise impacting beam characteristics including but not limited to shaping the beam, focusing the beam or polarizing the beam.

Laser system 60 also includes a power supply 72 and a control board 74 shown in FIGS. 4-7. A satisfactory laser module 62 includes but is not limited to a red laser at 650 nm with an output power of 3.5 to 4.8 mW when powered by 3 volt lithium battery. It is understood the laser in the laser module 62 can be any of a variety of lasers such as, but not limited to infrared lasers, lasers emitting at 532 nm; 635 nm or 850 nm. Power supply 72 can be any of a variety of commercially available batteries, either rechargeable or disposable.

In one configuration, control board 74 is also commercially available and sold in conjunction with the laser module 62. Here too, in other configurations custom designed and built boards and components may be used for control board 74.

Control board 74 determines operation of laser system 60. In this regard control board 74 may have a microprocessor, programmable analog device, microcontroller and other components such as memory and ports as is necessary to execute control logic for laser system 60. Optionally control board 74 may also execute control logic expressed in the form of hard wired electronics. Control board 74 is connected to power supply 72 and includes an activation sensor 76 for selectively operating or supplying laser module 62 with power. Activation sensor 76 can take the form of any devices, apparatus or mechanism that can sense a condition indicating that a change of state of an operating condition of firearm accessory 20 is to be made. Without limitation, such an activation sensor can take the form of an electro-mechanical switch, electro-optical switch or any kind of optical, mechanical, electro-mechanical, electromagnetic, electro-optic, electrical, sonic, sensory or sensing system, or transducer known for sensing physical conditions. In a simple embodiment, activation sensor 76 can take the form of a mechanically operated electrical switch. A switch type activation sensor 76 can include or be connected to an arm 78 that is accessible outside of the housing 30. In this embodiment, housing 30 engages a portion of trigger guard 16 of firearm 10, and a switch type activation sensor 76 is located longitudinally intermediate muzzle 13 and trigger guard 16, below barrel 12 of firearm 10. Further, activation sensor 76 is disposed outside of the periphery of trigger guard 16 and forward of trigger guard 16.

In addition, switch type activation sensor 76 can be configured such that switch type activation sensor 76 is moveable from a center, off, position to a left, on, position or a right, on, position. Arm 78 is sized and positioned such that in the center off position a portion of switch type activation sensor 76 is accessible to each of the left and right sides of housing 30 by virtue of the construction of housing 30, such as by associated depressions or recesses 31 as seen FIGS. 1, 2, 3A-3C and the sizing of arm 78. Switch type activation sensor 76 can therefore be actuated by the user through contact from either side of housing 30, thus providing non-handed actuation. That is, an outside surface of housing 30 can include recesses, depressions or dimples 31 adjacent to arm 78 so that arm 78 is moveable relative to housing 30 while at least initially being within a width of housing 30.

Further, arm 78 can be sized so that the dimension of switch type activation sensor 76 transverse to barrel 12 is no greater than a width of firearm 10 or frame 14. Thus, if firearm 10 is holstered such that the sides of firearm 10 contact a holster (not shown), arm 78 being dimensioned to be within the width of the firearm 10 or frame 14 does not contact the holster and thus minimizes unintended operation of firearm accessory 20. For example, for use with the Ruger LCP sold by Sturm, Ruger & Co., Inc., Southport, Conn., USA having a frame width of approximately 0.82 inches, the arm 78 would have a dimension along the transverse direction of approximately 0.74 inches, or less. Therefore, in the off (centered) position of arm 78, arm 78 lies within a width of frame 14 or firearm 10.

Such an optional control arrangement allows a user to adjust a operation of firearm accessory 20 using finger contact with firearm accessory 20. However, in certain circumstances a user may in addition wish to have the option to change an operation of a firearm accessory 20 so that accessory 20 activates based upon whether or not the user is gripping firearm 10.

This presents a challenge in that, on the embodiment shown in FIGS. 1-7, housing 30 of firearm accessory 20 positions an electronic system such as laser module 62, control board 74, and actuation sensor 90 forward of a trigger guard 16 of firearm 10 while the grip is to the rear of trigger guard 16.

In the embodiment illustrated in FIGS. 1-7, this challenge is met in part by a grip activation system 20 that uses housing 30 to position a grip force receiving surface 100 proximate to grip 18 such that a person gripping firearm 10 at grip 18 will apply force against grip force receiving surface 100. However, because grip 18 is separated from an actuation sensor 90 by a length of trigger guard 16 grip activation system 22 provides a linkage 110 that responds to a change in force applied against grip force receiving surface 100 by using energy from such a change in force to cause a change in conditions proximate to an actuation sensor 90 of control board 74. Actuation sensor 90 and control board 74 are arranged so that control board 74 is responsive to signals from actuation sensor 90 and can determine whether to change operation of laser system 60 or other electronic systems that may be incorporated in a firearm accessory 20 based upon these signals.

Actuation sensor 90 is configured to sense conditions proximate to actuation sensor 90. This can involve sensing any of a plurality of conditions including the presence or absence of contact of an object with actuation sensor 90, an extent of contact of an object with actuation sensor 90, an amount of force, tension, torsion, shear, stress, or strain, vibration, or any other conditions caused by an object in contact with actuation sensor 90, the presence absence or relative proximity of an object proximate to actuation sensor 90 such as may be done using sensors that sense electromagnetic fields, electrical pathways, optical pathways, force waves, vibrations or other such conditions. Grip force receiving surface 100 is associated with linkage 110 such that a change in force against grip force receiving surface 100 influences linkage 110 in such a way that can be sensed by actuation sensor 90 and used by control board 74 in determining how to operate firearm accessory 20.

It will be appreciated that linkage 110 provides a physical structure, apparatus, or system that allows a force applied at a grip force receiving surface 100 to create a change that can be sensed at an actuation sensor that is separated from the grip force receiving surface by a distance that can be, for example, at least half of a length of a trigger guard 16 of a firearm 10 to which firearm accessory 20 is joined. In this embodiment, linkage 110 movably extends within a pathway 120 defined at least in part by housing 30 between grip force receiving surface 100 and a position proximate to actuation sensor 90.

It will be appreciated that actuation sensor 90, grip force receiving surface 100, linkage 110 and pathway 120 can take on a variety of forms in various embodiments.

Figure 8:
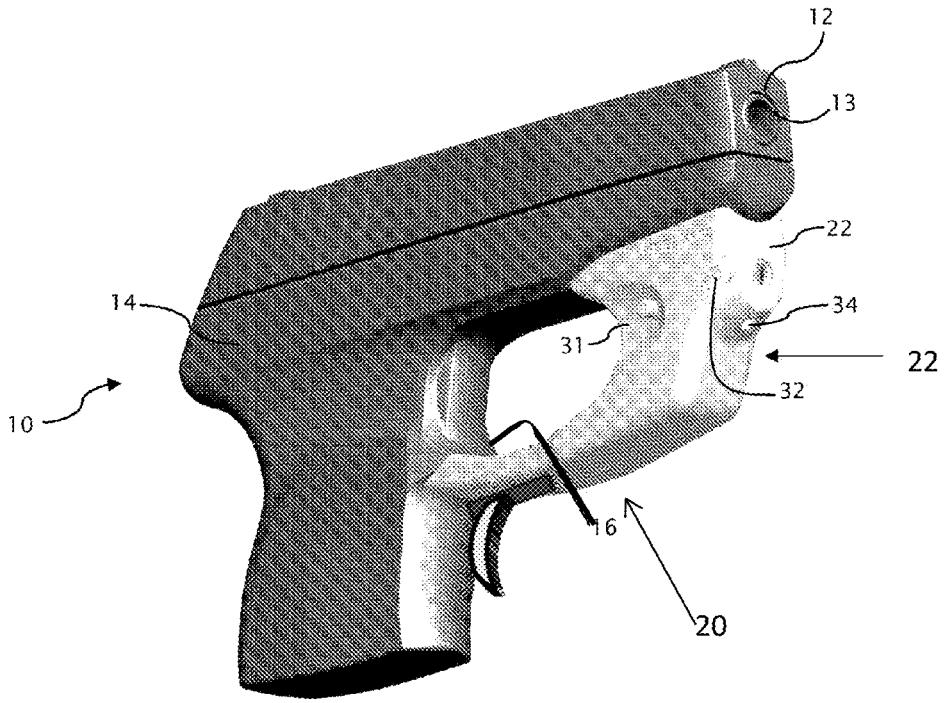
FIG. 8 is a perspective view of a firearm accessory having a grip activation system, wherein the laser sight is connected to a firearm and the grip activation system is shown with the grip force sensing surface in a forced position.

In the embodiment illustrated in FIGS. 1-7, grip force receiving surface 100 is a surface that is positioned by housing 30 under trigger guard 16 and proximate to but separated from grip 18. When a user grasps firearm 10, the user will simultaneously grasp grip force receiving surface 100 and apply force thereto to grip firearm 10. Housing 30 and grip force receiving surface 100 are configured so that in response to such force grip force receiving surface 100 slideably moves along a generally longitudinal axis from the position shown in FIG. 1 to the position shown in FIG. 8.

Linkage 110 is joined to grip force receiving surface 100 and for movement within pathway 120. In this embodiment, force against grip force receiving surface 100 urges grip force receiving surface 100 toward grip 18 and the position of an actuation portion 112 of linkage 110 is moved from the position illustrated in FIG. 7 to the position shown in FIG. 9. Actuation sensor 90 is adapted to sense this change and control board 74 is adapted to adjust operation of firearm accessory 20 in response to this such as, in this embodiment, by activating or deactivating laser module 62 or changing a mode of operation of laser module 62.

Figure 9:
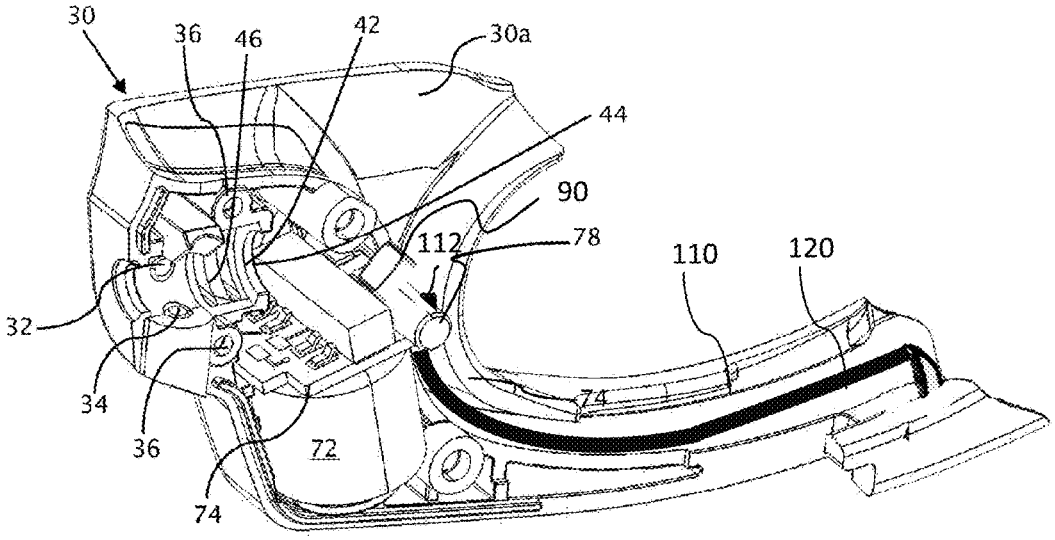
FIG. 9 is the perspective view of FIG. 7, having the laser cover, the coupling and the laser module removed with the grip force receiving surface and linkage in a second, forced position.

Grip force receiving surface 100 or linkage 110 can be biased so that upon release of force against grip force receiving surface 100, grip force receiving surface 100 is returned to the position illustrated in FIG. 1 and linkage 110 is returned to the position illustrated in FIG. 9. In one approach, grip force receiving surface 100 may be biased by an optional spring or other biasing member 108 to return to the position shown in FIG. 7 when released. In such an embodiment, a linkage 110 may be sufficiently rigid so that it can be thrust to move linkage 110 between the position in FIG. 9 and the position shown in FIG. 7 as force against grip force receiving surface 100 is released.

Alternatively, as is illustrated in FIG. 3B an optional tensioner 114 may be positioned to apply a tension in linkage 110 drawing linkage 110 and grip force receiving surface 100 from a force applied position such as the position shown in FIG. 9 and a release position such as the position shown in FIG. 7. In embodiments, tensioner 114 can take the form of a spring or other resilient member or structure joined to linkage 110 to pull linkage 110 such that grip force receiving surface 100 is urged away from grip 18. Tensioner 114 can comprise a winding or coiling mechanism for winding or coiling linkage. In embodiments where tension is applied through linkage 110 linkage 110 may comprise without limitation a film, cable, tape, wire or other flexible connector. Optionally such tensioner 114 may move or change in ways that can be sensed by actuation sensor 90 to determine a position of grip force receiving surface 100.

In still another embodiment, linkage 110 itself may be resilient and capable of non-plastic extension sufficient to allow travel of grip force receiving surface 100 between the positions shown in FIGS. 1 and 7 and therefore can provide both a return bias to return grip force receiving surface to an initial position such as the position shown in FIG. 1 from a force applied position. Here actuation sensor 90 can sense stretching, an increase in force applied to a mounting point for linkage 110 or other effects caused by resilient deformation of linkage 110.

Figure 10:
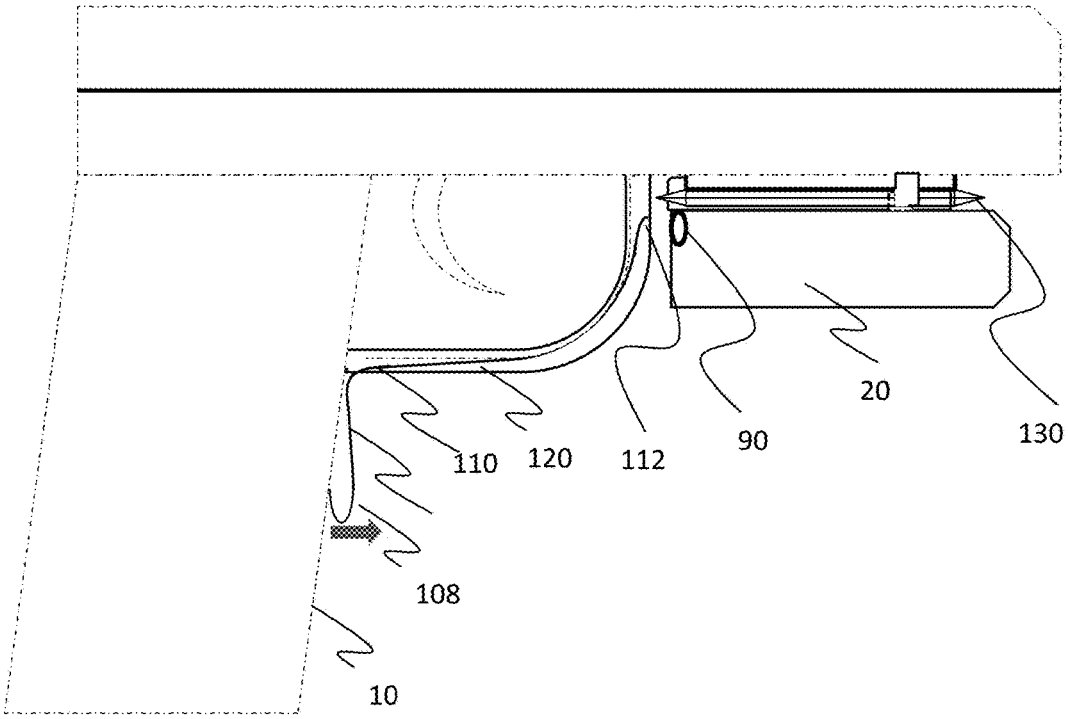
FIG. 10 is another embodiment of a firearm accessory and grip activation system with a grip force receiving surface and linkage in a first position.

FIG. 10 illustrates yet another embodiment of firearm accessory 20 having a grip activation system 22. Here firearm accessory 20 and grip activation system 22 has a housing 30 and firearm accessory 20 is shown having an independent housing 21 of a rail mount type that is mountable to a rail 130 of firearm 10.

Figure 11:
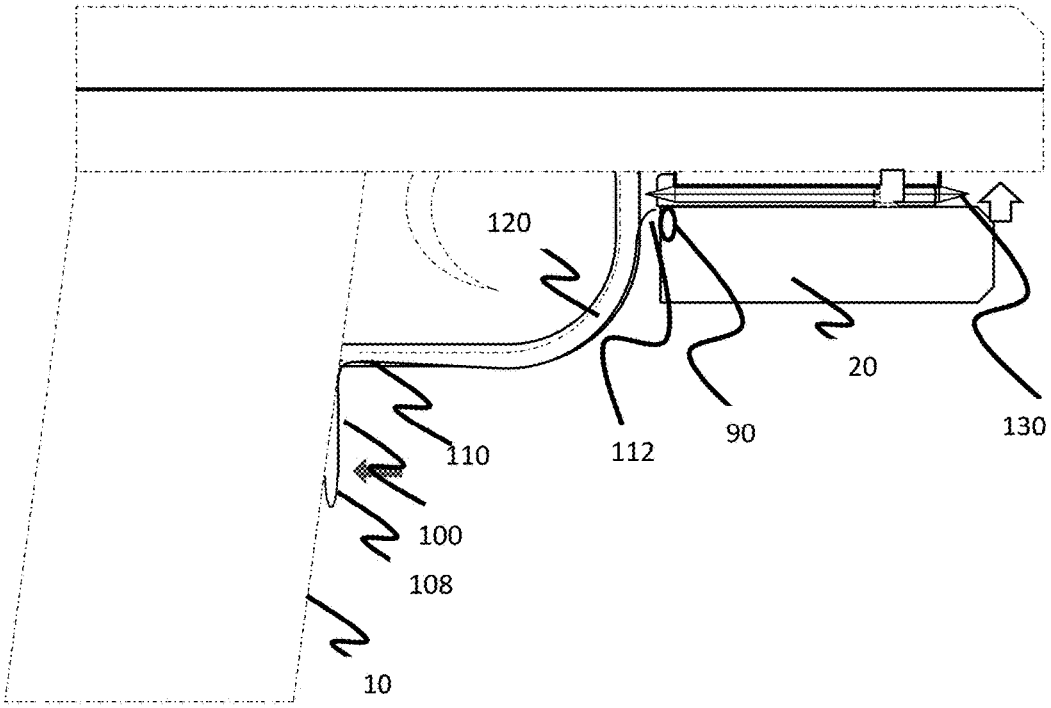
FIG. 11 is the embodiment of FIG. 10 with the grip force receiving surface and linkage in a second position.

In this embodiment, linkage 110 rocks within pathway 120 between a first orientation shown in FIG. 10 and a second orientation shown in FIG. 11. A biasing member 108 biases linkage 110 into the first orientation. In the first orientation, where actuation portion 112 of linkage 110 is positioned at a first position relative to actuation sensor 90 of firearm accessory 20. When force is applied against grip force receiving surface 100, grip force receiving surface 100 moves proximate to grip 18 and this causes the orientation of linkage 110 to change with in pathway 120 such that actuation portion 112 of linkage 110 is positioned at a second position relative to actuation sensor 90. Here again actuation sensor 90 senses this change in orientation and control board (not shown) adjusts operation of firearm accessory 20.

Figure 12:
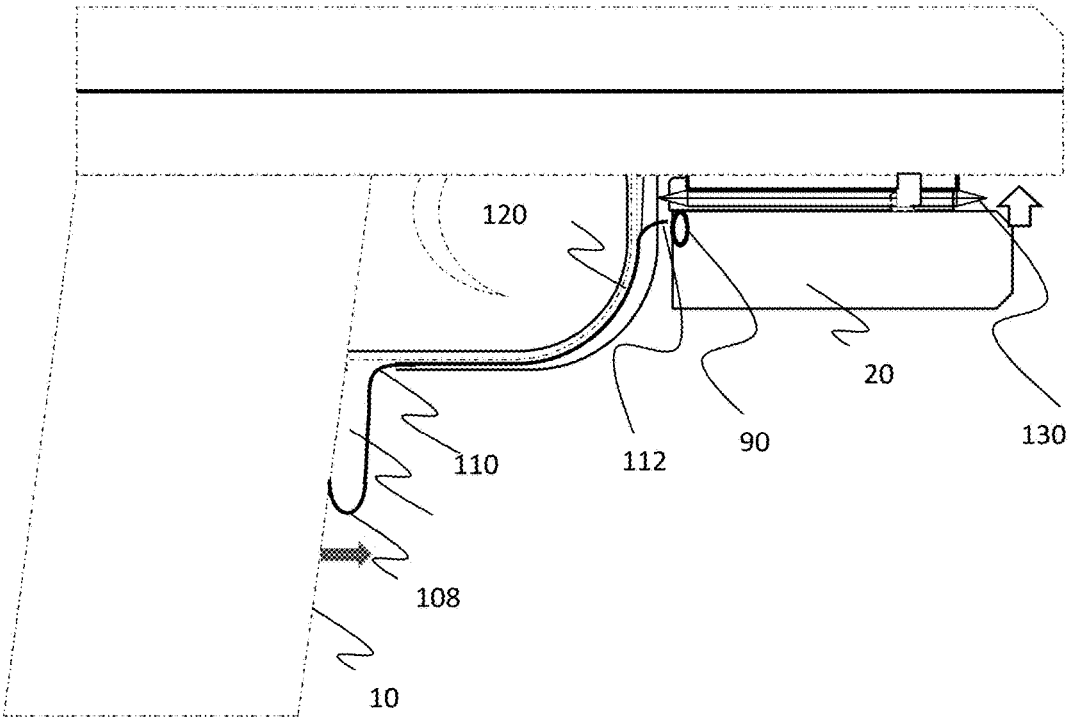
FIG. 12 is another embodiment of a firearm accessory and grip activation system with a grip force receiving surface and linkage in a first orientation.
Figure 13:
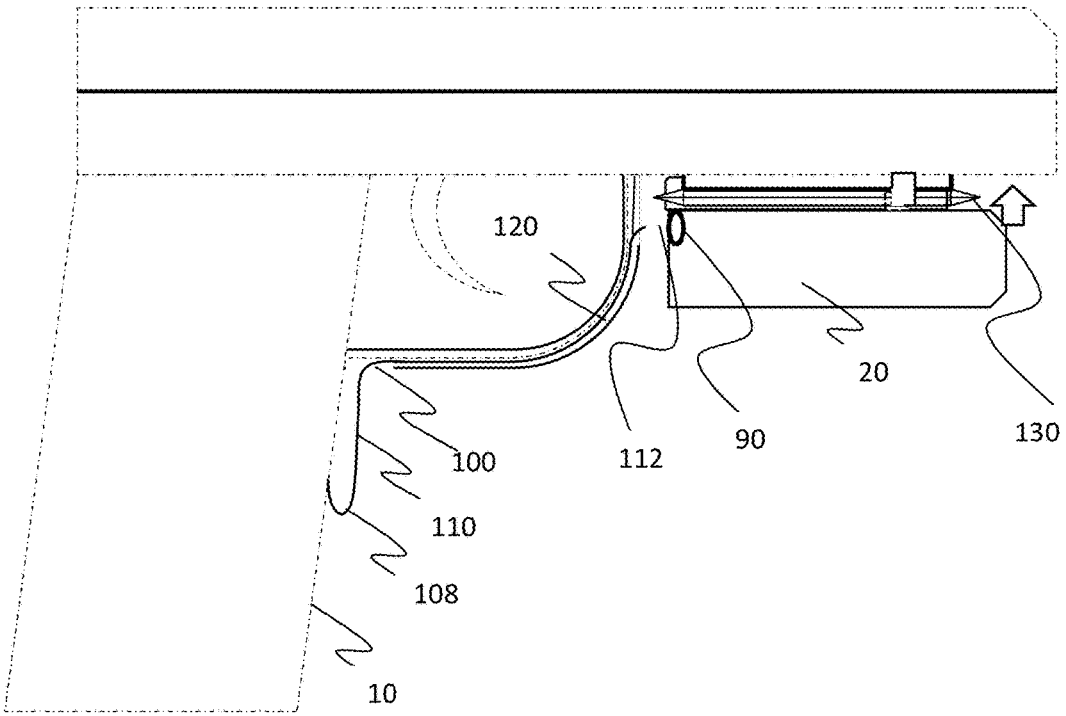
FIG. 13 is the embodiment of FIG. 12 with the grip force receiving surface and linkage in a second orientation.

FIGS. 12 and 13 illustrate another example of a of an arrangement of a linkage 110 and grip force receiving surface 100 useful with an actuation sensor 90. Here linkage 110 is positioned within a pathway 120 such that the linkage slides into a position that can be sensed by actuation sensor 90 when the gripping force is applied against the grip receiving surface 100 and is biased away from the position by biasing member 108. Here linkage 110 is slidably movable within pathway 120 between a first position shown in FIG. 12 where actuation portion 112 is proximate actuation sensor 90 and a second position shown in FIG. 13 where actuation portion 112 of linkage 110 is more distant from actuation sensor 90. Here again actuation sensor 90 senses this change in orientation and control board (not shown) adjusts operation of firearm accessory 20.

Figure 14:
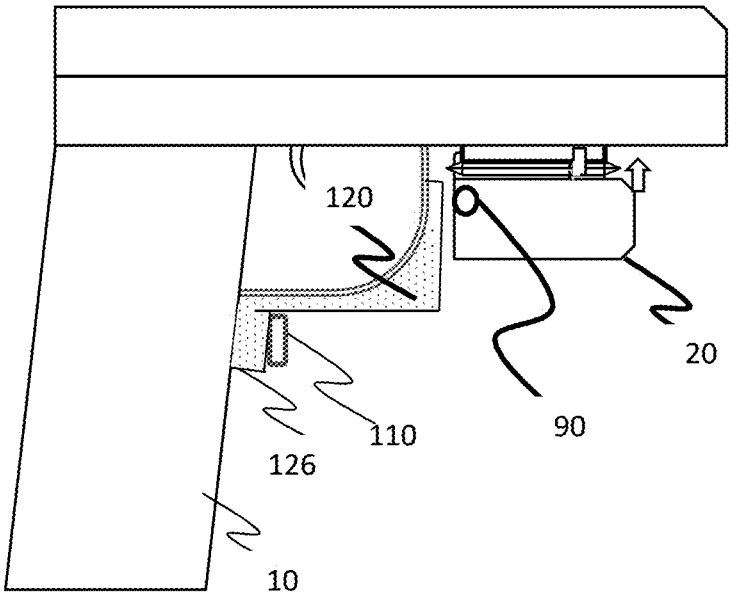
FIG. 14 is another embodiment of a firearm accessory and grip activation system with a grip force receiving surface and linkage in a first position.
Figure 15:
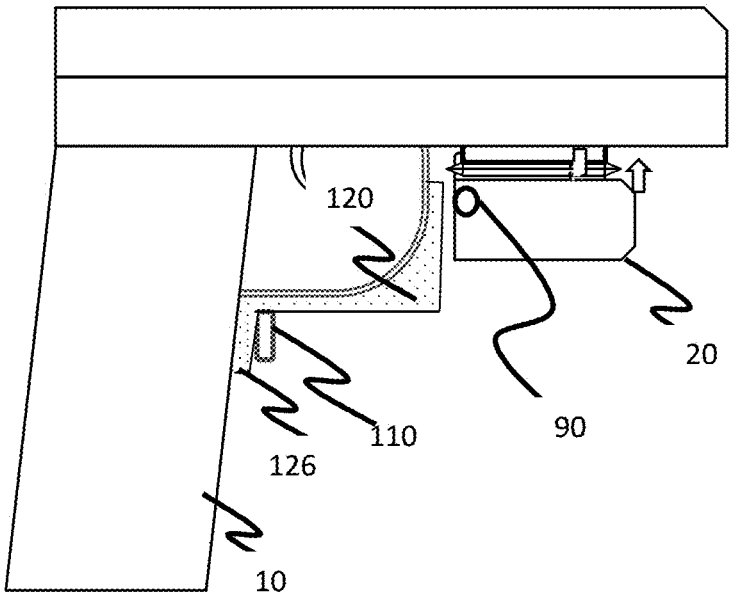
FIG. 15 is the embodiment of FIG. 14 with the grip force receiving surface and linkage in a second position.

FIGS. 14 and 15 illustrate respectively another embodiment wherein the linkage comprises a fluid material flows through pathway 120 such that force applied at grip force receiving surface 100 pressurizes fluid in chamber 126 to create a change in conditions proximate to actuation sensor 90. Here, this change is illustrated conceptually as a change in the presence or absence of fluid linkage 110 near actuation sensor 90. In other embodiments other fluidically conveyed changes are possible such as the application of force created in pathway 120 against actuation sensor 90.

In embodiments, grip force receiving surface 100 and linkage 110 may be defined so that they encounter a hand or finger of a hand gripping grip 18 such that as a user's grip closes about grip 18, grip force receiving surface 100 receives this force and is moved in a direction other than generally longitudinally as illustrated. For example, grip force receiving surface 100 may retreat at least in part upwardly into housing 30. Additionally grip force receiving surface 100 may move in a lateral direction.

In embodiments grip force receiving surface 100 may be located at any position along a length of a lower end of trigger guard 16. In embodiments grip force receiving surface 100 may be located on or in grip 18 and for example may take the form of a portion of a grip 18.

In embodiments, a biasing member may be positioned within pathway 120 to bias linkage 110 in a particular direction or orientation.

In embodiments linkage 110 may be biased into contact with an actuation sensor 90 and linkage 110 and grip force receiving surface 100 may be configured so that the application of a grip force against grip force receiving surface 100 separates linkage 110 from contact with actuation sensor 90. In one such embodiment, actuation sensor 90 may comprise a pair of electrical contacts arranged in cooperation with a linkage 110 that is at least partially conductive such that linkage 110 may be advanced into contact with the electrical contacts to close a circuit between the electrical contacts.

In embodiments, an amount of grip force necessary to cause linkage 110 to move so that actuation sensor 90 detects a condition that indicates to control board 74 that there has been a user input can be adjustable. In one embodiment this can be done by adjusting an amount of tension or bias applied to linkage 110. In another embodiment this can be done by adjusting one or more pivot or leverage points of linkage 110, a location of a connection between linkage 110 and grip force receiving surface 100, or a location of a point of a pivot or an extent of leverage between grip force receiving surface 100 and housing 30. Additionally, in embodiments, a mechanical advantage of linkage 110 may be adjustable. In still further embodiments an amount of friction experienced by linkage 110 may be adjustable. Similarly a bias member such as biasing member 108 may be adjustable.

In embodiments, a first range of grip force applied to a grip force receiving surface 100 cause linkage 110 to create a first condition that can be sensed by actuation sensor 90 and from which control board 74 can determine a first control outcome and a second range of grip force applied to a grip force receiving surface creates a second condition that can be sensed by actuation sensor 90 and from which control board 74 can determine a second control outcome. In one such embodiment, an application of a first range of grip force can cause linkage 110 to move to a first range of positions relative to actuation sensor 90 while a second range of grip force can cause linkage 110 to move to a second range of positions relative to actuation sensor 90. This may be reflected in different extents of travel of the grip force receiving surface 100 from an initial position. In such embodiments, for example, a first extent travel of the grip force receiving surface 100 from an initial to a final position may be used to bring linkage 110 into a position more proximate to actuation sensor 90 so as to ensure that actuation sensor 90 continues to send signals indicative of the second control outcome irrespective of minor changes in relative positioning that may arise as a function of inertial forces or accelerations that may occur during use.

Additionally, in embodiments, further travel of the grip force receiving surface 100 may be used to build a bias force urging linkage 110 against an actuation sensor 90 so that inertial forces or accelerations do not cause unintended separations of linkage and actuation sensor 90 when grip force receiving surface 100 has been gripped and forced to its full length of travel.

Although firearm 10 has shown as a hand gun, it is understood that firearm accessory 20 or grip activation system 20 are not limited to use with handguns, but can be employed with any pistol, gun, or rifle that selectively launches a projectile, whether by compressed gas, combustion or electromagnetic actuation. It will be appreciated that that embodiments may take the forms useful with simulated firearms such as a weapon shaped training device, or other grip controlled devices such as those that emit directed electromagnetic, fluidic and sonic outputs and models and simulators thereof. Firearm accessory 20 or grip activation system 22 may be used with non-firearm products having a grip.

Firearm accessory 20 has been described in embodiments herein as being of a type a laser beam for sighting a target. However, this is not limiting and firearm accessory 20 may perform other functions and include components configured to perform functions including but not limited to any electronic, electromechanical or electro-optical or optical function including but not limited to image capture, visible illumination, non-visible but machine detectable illumination, non-lethal deterrent operations, audio and video recording and digital data capture, processing and storage.

It will also be appreciated that linkage 110 and grip force receiving surface 100 may be separately joinable to accessory 20 such that an accessory 20 may be sold without linkage 110 and grip force receiving surface 100 but may allow accessory 20 to be joined to a linkage 110 and grip force receiving surface 100 if desired. Optionally, in embodiments of this type, a separate housing may be provided for these components. These approaches allow generic rail mountable firearm accessories that have an actuation sensor 90 to be joined linkages and grip force receiving surfaces 100 that are adapted for use with the unique shapes of particular trigger guards.

Additionally, it will be understood that there are a wide variety of rail mountable lasers that have ports for receiving switch inputs from external activation switches such as pressure switches. In embodiments, a linkage 110, grip force receiving surface 100 and actuation sensor 90 can be provided as a unit with an output that is designed to be connected to such ports and used to send signals that mimic those of the conventional pressure switch.

Additionally, it will be understood that any of a variety of different biasing members 108 can be used, including types that have adjustable bias forces. This enables user customization.

The invention has been described in detail with particular reference to certain preferred embodiments thereof, but it will be understood that variations and modifications can be effected within the spirit and scope of the invention.

What is claimed is:

1. An accessory for use with a firearm having a grip, a trigger guard and a barrel extending from the grip past the trigger guard, the accessory comprising:

a grip force receiving surface;

a housing configured to position an electronic system, a control system, the grip force receiving surface and a linkage relative to the firearm, with the grip force receiving surface positioned proximate to the grip of the firearm such that a person gripping the firearm will apply force against the grip force receiving surface;

a tensioner positioned to apply a tension in the linkage urging the linkage and grip force receiving surface from a force applied position toward a release position;

wherein the grip force receiving surface is associated with the linkage such that a change in the grip force applied against the grip force receiving surface causes the linkage to cause a change in a condition that can be sensed by an actuation sensor that is at least a half of a length of the trigger guard away from the grip force receiving surface with the control system determining operation of the electronic system based at least in part on the condition sensed by the actuation sensor.

2. The accessory of claim 1, wherein the tensioner comprises at least one of a spring, a resilient member and a resilient structure joined to the linkage to pull linkage such that grip force receiving surface is urged away from the grip.

3. The accessory of claim 1, wherein the tensioner comprises a winding or coiling mechanism for winding or coiling the linkage.

4. The accessory of claim 1, wherein the linkage comprises at least one of a film, cable, tape, wire, rope, chain other flexible connector.

5. The accessory of claim 1, wherein a force applied to the grip force receiving surface causes the tensioner to move in a way that can be sensed by actuation sensor and used to determine that a force has been applied to the grip force receiving surface.

6. An accessory for use with a firearm having a grip, a trigger guard and a barrel extending from the grip past the trigger guard, the accessory comprising:

a grip force receiving surface;

a housing configured to position an electronic system, a control system, the grip force receiving surface and a linkage relative to the firearm, with the grip force receiving surface positioned proximate to the grip of the firearm such that a person gripping the firearm will apply force against the grip force receiving surface;

wherein the grip force receiving surface is associated with the linkage such that a change in the grip force applied against the grip force receiving surface causes the linkage to cause a change in a condition that can be sensed by an actuation sensor that is at least a half of a length of the trigger guard away from the grip force receiving surface with the control system determining operation of the electronic system based at least in part on the condition sensed by the actuation sensor and wherein the linkage is positioned within a pathway such that the linkage rocks in a manner that can be sensed by the actuation sensor when the gripping force is applied against the grip receiving surface.

7. An accessory for use with a firearm having a grip, a trigger guard and a barrel extending from the grip past the trigger guard, the accessory comprising:

a grip force receiving surface;

a housing configured to position an electronic system, a control system, the grip force receiving surface and a linkage relative to the firearm, with the grip force receiving surface positioned proximate to the grip of the firearm such that a person gripping the firearm will apply force against the grip force receiving surface;

a pathway containing a fluid and wherein the grip force applied against the grip receiving surface moves the fluid in a manner that can be sensed by the actuation sensor;

wherein the grip force receiving surface is associated with the linkage such that a change in the grip force applied against the grip force receiving surface causes the linkage to cause a change in a condition that can be sensed by an actuation sensor that is at least a half of a length of the trigger guard away from the grip force receiving surface with the control system determining operation of the electronic system based at least in part on the condition sensed by the actuation sensor.

8. An accessory for use with a firearm having a grip, a trigger guard and a barrel extending from the grip past the trigger guard, the accessory comprising:

a grip force receiving surface;

a housing configured to position an electronic system, a control system, the grip force receiving surface and a linkage relative to the firearm, with the grip force receiving surface positioned proximate to the grip of the firearm such that a person gripping the firearm will apply force against the grip force receiving surface;

wherein the grip force receiving surface is associated with the linkage such that a change in the grip force applied against the grip force receiving surface causes the linkage to cause a change in a condition that can be sensed by an actuation sensor that is at least a half of a length of the trigger guard away from the grip force receiving surface with the control system determining operation of the electronic system based at least in part on the condition sensed by the actuation sensor and wherein a first range of grip force applied to a grip force receiving surface causes the linkage to create a first condition that can be sensed by actuation sensor and from which the control system can determine a first control outcome and a second range of grip force applied to a grip force receiving surface creates a second condition that can be sensed by actuation sensor and from which the control system can determine a second control outcome.

9. The accessory of claim 8, wherein further travel of the grip force receiving surface to a final position may be used to bring linkage into a position more proximate to actuation sensor so as to ensure that actuation sensor continues to send signals indicative of the second control outcome irrespective of minor changes in relative positioning that may arise as a function of inertial forces or accelerations that may occur during use.

10. An accessory for use with a firearm having a grip, a trigger guard and a barrel extending from the grip past the trigger guard, the accessory comprising:

a grip force receiving surface;

a housing configured to position an electronic system, a control system, the grip force receiving surface and a linkage relative to the firearm, with the grip force receiving surface positioned proximate to the grip of the firearm such that a person gripping the firearm will apply force against the grip force receiving surface;

wherein the grip force receiving surface is associated with the linkage such that a change in the grip force applied against the grip force receiving surface causes the linkage to cause a change in a condition that can be sensed by an actuation sensor that is at least a half of a length of the trigger guard away from the grip force receiving surface with the control system determining operation of the electronic system based at least in part on the condition sensed by the actuation sensor and wherein the linkage comprises a fluid material through a pathway such that force applied at grip force receiving surface pressurizes fluid in a chamber to create a change in conditions proximate to the actuation sensor.

11. The accessory of claim 10, wherein the fluidically conveyed change comprises an application of force created in pathway against the actuation sensor.

12. A method for actuating an accessory for use with a firearm having a grip, a trigger guard and a barrel extending from the grip past the trigger guard, the method comprising:

receiving a grip force at a grip force receiving surface positioned at least one half of a trigger guard length away from an actuation sensor in the accessory;

using at least a portion of the grip force to create a change in a physical condition proximate to the actuation sensor that the actuation sensor is adapted to sense;

using the sensed change in physical condition to determine a control output for an electronic system in the firearm accessory wherein the portion of the grip force is used to change in a position of a linkage relative to the actuation sensor.

* * * * *